US006511551B2

(12) United States Patent
Kim et al.

(10) Patent No.: US 6,511,551 B2
(45) Date of Patent: Jan. 28, 2003

(54) METHOD OF PRODUCTION WC/CO CEMENTED CARBIDE USING GRAIN GROWTH INHIBITOR

(75) Inventors: Byoung-Kee Kim, Sapajung-dong (KR); Gook-Hyun Ha, Pusan (KR); Yong-Won Woo, Kyunggi-do (KR)

(73) Assignee: Korea Institute of Machinery and Materials, Taejon (KR)

( * ) Notice: Subject to any disclaimer, the term of this patent is extended or adjusted under 35 U.S.C. 154(b) by 0 days.

(21) Appl. No.: 09/881,764

(22) Filed: Jun. 18, 2001

(65) Prior Publication Data

US 2002/0043130 A1 Apr. 18, 2002

(30) Foreign Application Priority Data

Jun. 19, 2000 (KR) ..... 2000-33665

(51) Int. Cl.[7] ..... C23C 8/60
(52) U.S. Cl. ..... 148/237; 423/440
(58) Field of Search ..... 148/237; 423/440

(56) References Cited

U.S. PATENT DOCUMENTS 4,162,392 A * 7/1979 Brown et al.
5,352,269 A * 10/1994 McCandlish et al. ..... 75/351
5,841,045 A * 11/1998 McCandlish et al. ..... 75/236
5,869,019 A * 2/1999 Seegopaul ..... 423/440
5,885,372 A * 3/1999 Seegopaul ..... 148/237
6,254,658 B1 * 7/2001 Taniuchi et al. ..... 75/240

* cited by examiner

*Primary Examiner*—Ngoclan Mai
(74) *Attorney, Agent, or Firm*—Lowe Hauptman Gilman & Berner, LLP

(57) ABSTRACT

The present invention relates to a method of adding a grain growth inhibitor of WC/Co cemented carbide, which comprises adding a water-soluble salt of V, Ta, or Cr component as a grain growth inhibitor, at the time of mixing water-soluble salts of W and Co during the initial production process of WC/Co cemented carbides. As a result, the present invention leads to the production of powder of homogeneous distribution of grain growth inhibitors, which in turn results in the enhancement of the mechanical properties thereof by effectively controlling the abnormal growth of WC during sintering in the production process of said cemented carbides.

2 Claims, 3 Drawing Sheets

METHOD OF PRODUCTION WC/CO CEMENTED CARBIDE USING GRAIN GROWTH INHIBITOR

TECHNICAL FIELD

The present invention relates to a method of producing WC/Co cemented carbide by chemically adding a grain growth inhibitor of WC/Co cemented carbide, and more particularly, to the method of producing WC/Co cemented carbide by adding a grain growth inhibitor during the initial production step of W and Co powders, which are the main components of said cemented carbide.

BACKGROUND OF THE INVENTION

Generally, as for WC/Co cemented carbides, compression molding is carried out while adding cobalt powder, which is a binding agent, to the extremely hard intermetallic compound (e.g., tungsten carbide). Then, it is heated at a high temperature, followed by sintering. These cemented carbides are used as materials for cutting tools, such as bits or dills.

The mechanical properties of said WC/Co cemented carbides are affected by the amount of binding metals (i.e., cobalt), and the grain size of WC. Moreover, the mechanical characteristics thereof are affected by the distances between the WC grains. In general, as the WC grains are reduced into finer particles, the mechanical characteristics thereof are enhanced. Hence, for inhibiting grain growth, WC/Co cemented carbide is produced with addition of a grain growth inhibitor.

As for the conventional method of producing WC/Co cemented carbides, for resolving the problems arising from the abnormal growth of WC grains, a grain growth inhibitor, such as VC, TaC, or carbide, is added to the WC/Co cemented carbide powder by a mechanical methods (i.e., ball-milling). However, there are difficulties and limitations with respect to homogeneously mixing the cemented carbide powder of fine grain particles into the grain growth inhibitors of 1.0 $\mu$m in size. Consequently, even after such mixing, the distribution of grain growth inhibitors is non-homogeneous, which in turn leads to the problem of partial abnormal growth of WC grains after the sintering process.

SUMMARY OF THE INVENTION

Accordingly, in solving the aforementioned problems, the technical objective of the present invention lies in providing a method of producing WC/Co cemented carbide by chemically adding a grain growth inhibitor for enhancing the degree of reduction into fine grain particles and the homogeneity thereof. In this regard, the production process is simplified by simultaneous reduction and carburization of cemented carbide powder and grain growth inhibitors by homogeneously mixing the same at a molecular level. In particular, in order to achieve such homogeneity, a growth grain inhibitor (i.e., VC, TaC, or Cr based water-soluble salt) in solution is added therein during the initial step of powder production.

In order to achieve the aforementioned technical objective, WC/Co cemented carbide is produced by:

preparing a precursor powder by spray-drying an initial solution of a mixture of water-soluble salts of W and Co, which are the main components of said cemented carbide;

adding and mixing a water-soluble salt including a grain growth inhibitor during mixing of said water-soluble salts of W and C;

desalting the precursor powder to remove salts by heating said precursor powder so as to obtain desalted oxide composites powder;

ball-milling to mix said desalted oxide powder and carbon black, resulting in composite oxides of fine particles; and preparing a composite cemented powder, by carburization and reduction, by heating said composite oxides of fine particles in a non-oxidative atmosphere.

Therefore, with respect to the conventional production process of precursor powder of cemented carbides, the present invention comprises mixing water-soluble salts of V, Ta, or Cr component (i.e., grain growth inhibitor) to the water-soluble salts of W and Co, which are the main components of cemented carbides.

The present invention is explained in detail as follows: The present invention comprises mixing by dissolving water-soluble metal salt for grain growth inhibitors, for example, ammonium meta-vanadate (AMV), Ta-chloride, or Cr-nitrate, to the aqueous solution containing water-soluble salt of W, for example, ammonium metatungstate ($(NH_4)_6(H_2W_{12}O_{40}).4H_2O$,AMT) and water-soluble salt of Co, for example, Co-nitrate($Co(NO_3)_2.6H_2O$), which are the main components of cemented carbide.

Of course, the cemented carbide powder is produced by first preparing the precursor powder by spray-drying, followed by desalting the precursor powder, and then ball-milling said precursor powder and carbon black for mixing and pulverizing the power for carburization, followed by actual carburization and reduction.

BRIEF DESCRIPTION OF DRAWING

FIG. 2(*b*) is a photograph of WC/Co cemented carbide powder.

FIG. 3(*b*) is a photograph showing the structure of cemented carbide prepared by the method of chemically adding the grain growth inhibitor under the present invention.

DETAILED DESCRIPTION OF THE PREFERRED EMBODIMENT

The present invention is described by means of an example as follows: To the final concentration of 10 wt % Co, 0.7 wt % VC and remainder WC, the solution was prepared by measuring and dissolving a water-soluble salt of V in water, which was used as a grain growth inhibitor, in addition to dissolving ammonium metatungstate (AMT, or $(NH)_4)_6(H_2W_{12}O_{40}).4H_2O$), and cobalt nitrate ($Co(NO_3)_2.6H_2O$).

The solution was spray-dried by using an open spray-dryer while maintaining the temperature of hot air intake at 200~300° C., and the temperature of hot air exhaust at 100° C. or higher. As a result, with the grain size distribution in the range of 20~50 μm, the precursor powder became a homogeneous mixture of globular grains of fine particles of W, Co and growth grain inhibitors.

Figure 1:
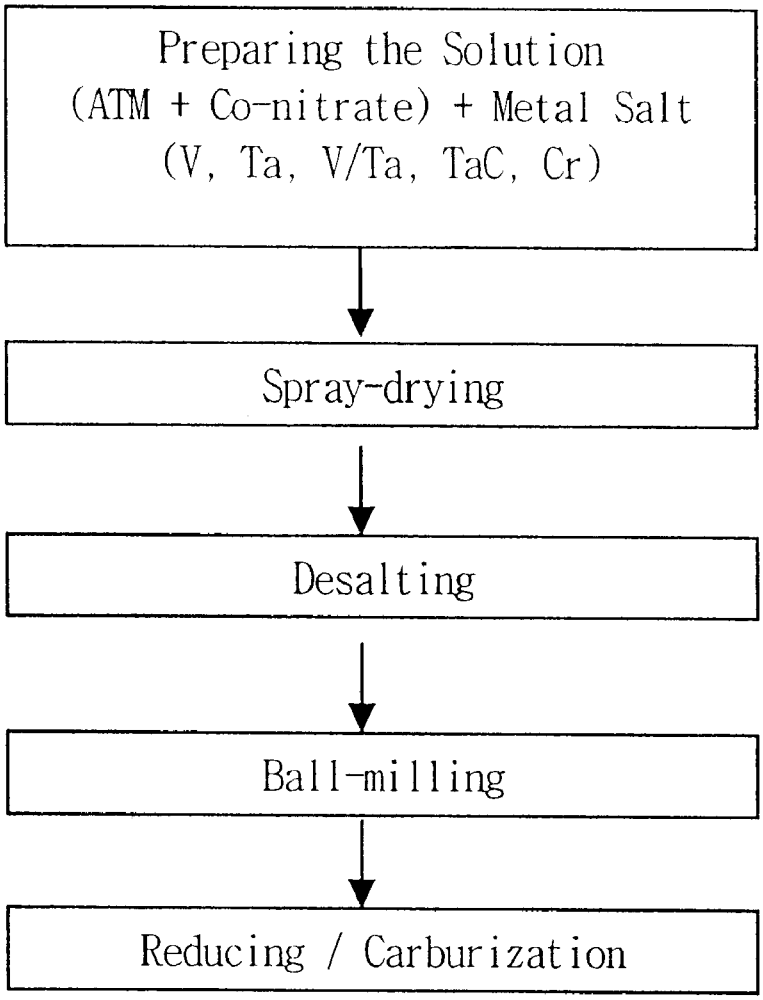
FIG. 1 is a flowchart for producing WC/Co cemented carbide powder.
Figure 2:
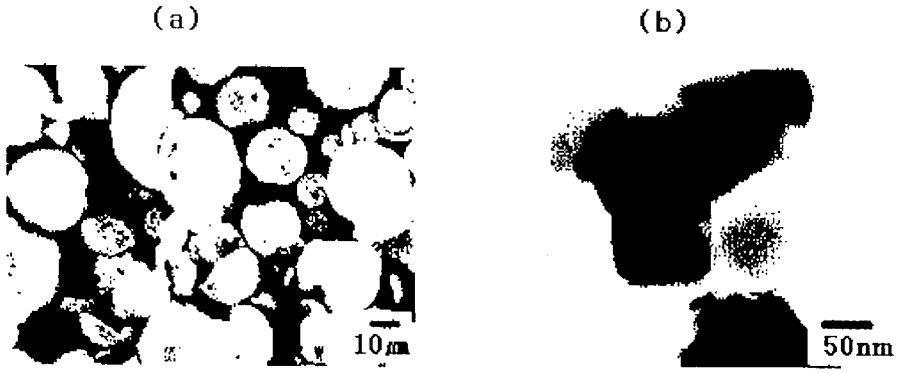
FIG. 2(*a*) is a photograph showing the powder after desaltation under the present invention.

In order to remove salts and remaining water, the precursor powder was heated at 400° C. in air. As a result, an oxide composite was produced having cohesion of oxides of V as grain growth inhibitors in a mixture with W-oxide and Co-oxide. It was confirmed that the oxide composite had a form as shown in FIG. 2(*a*). Then, the oxide composite powder after desaltation was mixed with carbon black, followed by milling the same in air for 24 hours by using a rotary ball-milling. At that time, in consideration of following reduction and decarburization of the oxides, the amount of carbon black, added thereto, was approximately 1.5 to 2.0 times the stoichiometry amount thereof. As a result, it was found that there were no changes in the phase of oxide grains, and that the powder was pulverized into fine particles, with homogenous mixing of carbon and the oxide powder.

The composite oxides of fine particles after ball-milling was heated at 800° C. for 24 hours in the non-oxidative atmosphere. At that time, in consideration of reduction and decarburization of the oxides, the amount of carbon black, added thereto, was approximately 1.5 to 2.0 times the stoichiometry amount thereof. As for the observation under microscope, as shown in FIG. 2(*b*), the WC/Co cemented carbides produced by using $H_2$ as a reaction gas had the average carbide grain size of 100 nm.

Figure 3:
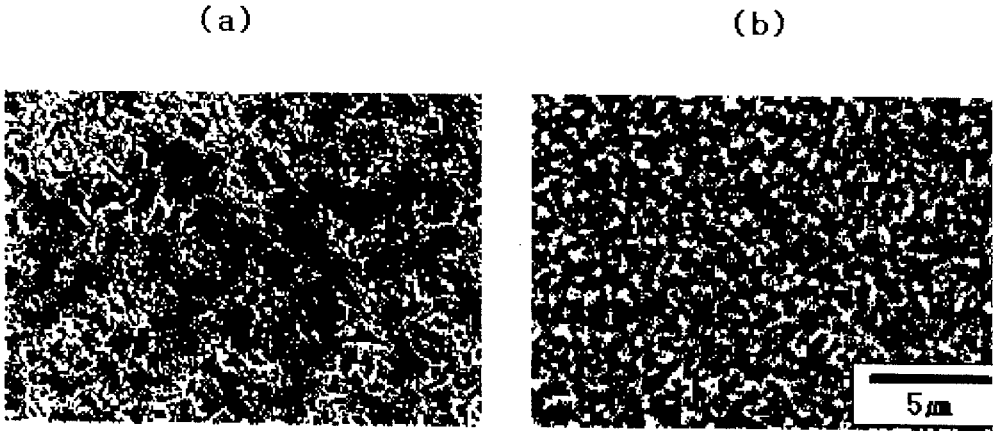
FIG. 3(*a*) is a photograph showing the structure of cemented carbide prepared by the conventional method of mechanically adding the grain growth inhibitor.

Further, in comparing the effects of adding the grain growth inhibitor on the mechanical properties thereof, the structure of cemented carbides produced by the method of chemical addition of the present embodiment was compared, as shown in FIG. 3, with that of the cemented carbides produced by the conventional method of mechanical addition.

As shown in FIG. 3, the structure produced by the method of addition under the present invention was finer and more homogenous as compared to that of the mechanical method. Without initial growth, WC was shown to retain the form of globular grains. This was attributed to the effective control of WC growth of during the sintering process by way of more homogeneous distribution within the structure produced by the method of chemical addition under the present invention.

Figure 4:
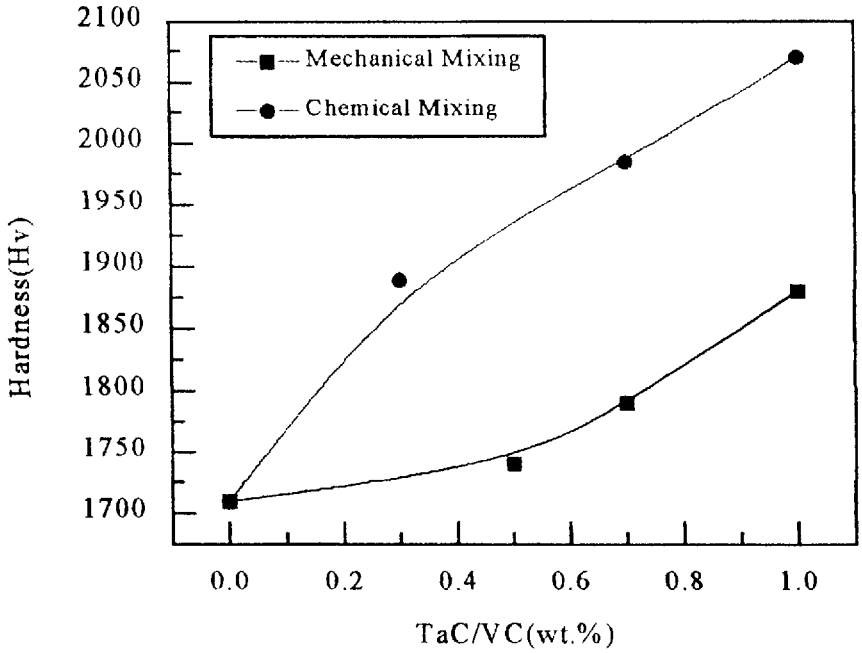
FIG. 4 is a graph, which compares the hardness of the products of cemented carbides produced by the conventional method of addition, and those produced by the method of addition under the present invention.

Moreover, by comparing the hardness thereof, the results as shown in FIG. 4 were obtained. According to FIG. 4, the method of chemical addition under the present invention showed a higher degree of hardness as compared to the method of mechanical addition. This was attributed to homogenous distribution of WC grains of fine particles, caused by inhibition of WC growth. Such inhibition of growth was achieved by initially adding the growth grain inhibitor via the chemical method, which in turn resulted in homogeneous distribution of growth grain inhibitors within the structure.

Figure 5:
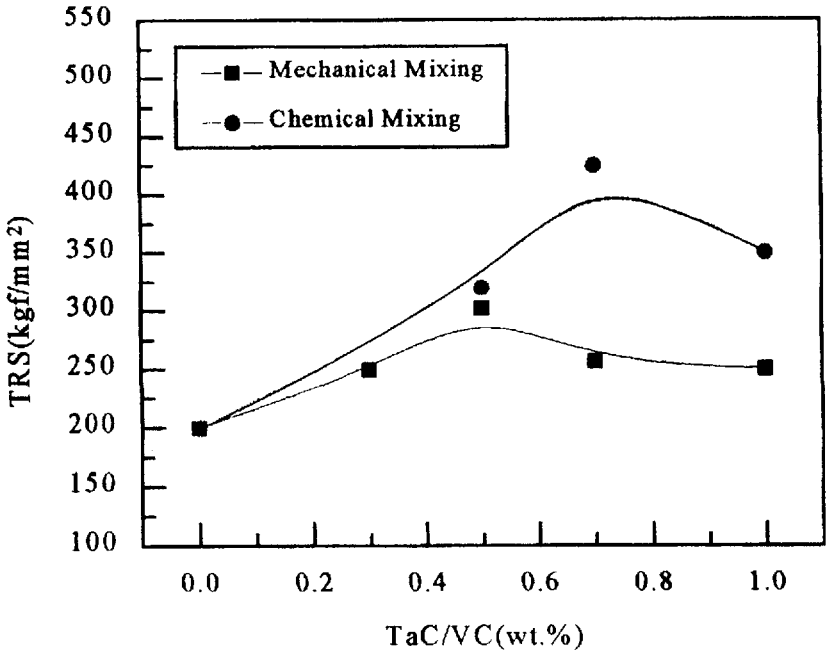
FIG. 5 is a graph, which compares the transverse rupture strength of the products of cemented carbides produced by the conventional method of addition, and those produced by the method of addition under the present invention.

Further, by comparing the transverse rupture strength thereof, the results as shown in FIG. 5 were obtained. In FIG. 5, the results changed significantly depending on the method of addition. The method of addition under the present invention showed superior transverse rupture strength as compared to the method of mechanical addition.

In summary, by chemically adding a grain growth inhibitor under the method of the present invention, more homogenous distribution could be achieved as compared to that of the conventional method of mechanical addition. Under the present invention, the mechanical properties are enhanced due to the effective control of WC growth during the sintering process.

The present invention has the effect of enhancing the mechanical properties thereof by means of effectively controlling the WC growth during the sintering process by producing a powder of homogeneous distribution of grain growth inhibitors and cemented carbides. Moreover, the present invention has the effect of lowering the production cost of WC/Co cemented carbides by means of simplifying the production process therein.

What is claimed is:

1. A method of producing WC/Co cemented carbide, comprising the steps of:

preparing a precursor powder by spray-drying an initial solution of a mixture of water-soluble salts of W and Co, which are the main components of said cemented carbide;

adding and mixing a water-soluble salt including a grain growth inhibitor during mixing of said water-soluble salts of W and Co;

desalting to remove salts by heating said precursor powder to obtain a desalted oxide composite powder;

ball-milling to mix said desalted oxide composite powder with carbon black, resulting in composite oxides of fine particles of the carbon black and oxide composite powder; and preparing a composite cemented powder, by carburization and reduction, by heating a mixture including the fine particles of the carbon black and oxide composite powder in a non-oxidative atmosphere.

2. The method of claim 1 wherein the carburization and oxidation step in the non-oxidative atmosphere is performed at about 800° C. for about 24 hours.

* * * * *